United States Patent [19]

Haller et al.

[11] 4,168,695

[45] Sep. 25, 1979

[54] PORTABLE BALL THROWING MACHINE HAVING OSCILLATORY FEATURE

[75] Inventors: Jack S. Haller, Chicago; Robert L. Moore, La Grange, both of Ill.

[73] Assignee: Rallymaster, Inc., Elk Grove Village, Ill.

[21] Appl. No.: 840,753

[22] Filed: Oct. 11, 1977

[51] Int. Cl.[2] ..... F41B 7/00

[52] U.S. Cl. ..... 124/16; 124/40; 124/34; 124/50

[58] Field of Search ..... 124/17, 16, 9, 33, 36, 124/41 R, 50, 31, 40, 53, 26; 273/26 D

[56] References Cited

U.S. PATENT DOCUMENTS

| | | | |
|---|---|---|---|
| 2,815,743 | 10/1957 | Brunderman | 124/50 X |
| 3,128,752 | 4/1964 | Andersen | 124/16 |
| 3,272,194 | 9/1966 | Egbert | 124/26 |
| 3,421,491 | 1/1969 | Brown | 124/9 |
| 3,610,223 | 10/1971 | Green | 124/16 |
| 3,821,945 | 7/1974 | Foster | 124/36 X |
| 3,880,135 | 4/1975 | Martin | 124/36 X |

*Primary Examiner*—Richard C. Pinkham
*Assistant Examiner*—William R. Browne
*Attorney, Agent, or Firm*—McDougall, Hersh & Scott

[57] ABSTRACT

A portable ball throwing macine employs a battery operated motor for projecting tennis balls for practice purposes. The balls are fed from a bin by means of a ball fence and agitator to a tube which conveys the ball to a ball track. A spring biased arm is cocked by the motor and released at the correct point in the cycle by operation of a cam gear and pawl. The arm then strikes the ball projecting it from the machine. Included in the device is an arrangement for oscillating the device from side to side to vary the pattern of balls projected from the machine and a gate mechanism to index balls onto the ball track.

19 Claims, 16 Drawing Figures

PORTABLE BALL THROWING MACHINE HAVING OSCILLATORY FEATURE

BACKGROUND OF THE INVENTION

This invention relates to devices for projecting balls. More specifically, it relates to a class of devices employed as aids in perfecting the game of tennis. Such devices typically are capable of receiving a large supply of tennis balls and of projecting them along a desired path towards the player who wishes to practice. In this manner the player can strike a number of balls to improve his tennis swing. The ball throwing device has a mechanism for reciprocating the fence and the upper tube with respect to each other.

Prior device have generally been large expensive machines suitable for purchase only by tennis clubs and the like. Additionally, such previous devices were not completely reliable and satisfactory in that balls fed into the machine tended to jam or otherwise improperly feed causing an interruption in the practice session. Similarly, adequate control over the path of the ball projected from these devices could not be obtained particularly where air pressure was utilized to eject the balls.

U.S. Pat. No. 3,272,194 to Egbert discloses a portable ball throwing machine which utilizes a spring biased arm for projecting tennis balls. This device does not have a ball bin but rather utilizes an S-shaped ball tube for storing a number of balls. The tube ends at the bottom of the machine and a complex lift mechanism including an arm, ball cup and retaining arm is employed to bring each ball to the top of the device where it is struck by the throwing arm. No means is provided for oscillating the machine to vary the ball trajectory.

It is accordingly an object of the present invention to provide a ball projecting device which is lightweight and portable.

It is a further object of the present invention to provide a motor operated ball projecting machine.

Another object of the invention is to provide a highly reliable ball projecting machine which includes means for feeding balls from a ball bin to the projecting means with a minimum of ball jams.

A further object of the invention is to provide a ball projecting device which permits convenient and accurate control of the force with which the balls are ejected from the device.

Another object of the invention is to provide means for oscillating the ball throwing machine from side to side by a selectable amount to vary the pattern with which the balls are projected towards the player.

Other objects and advantages of the invention will be apparent from the remaining portion of the specification.

DETAILED DESCRIPTION

Figure 1:
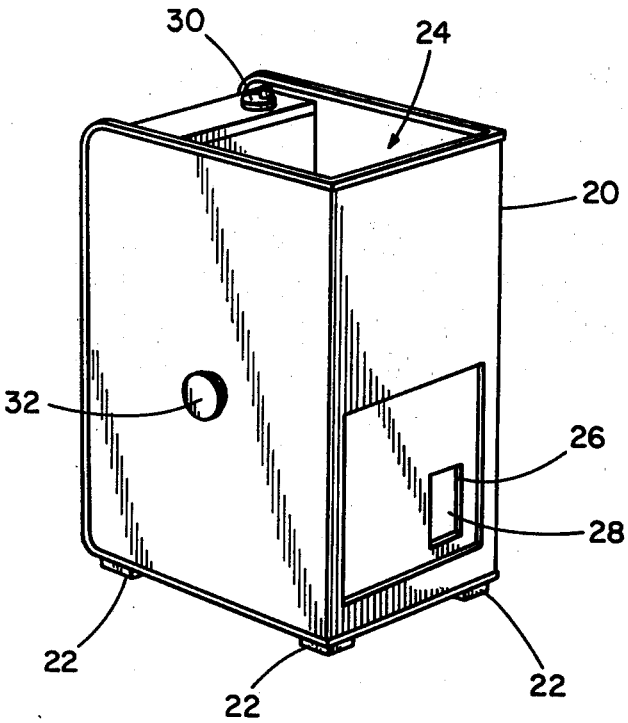
FIG. 1 is a front perspective of a ball throwing machine according to the invention.
Figure 2:
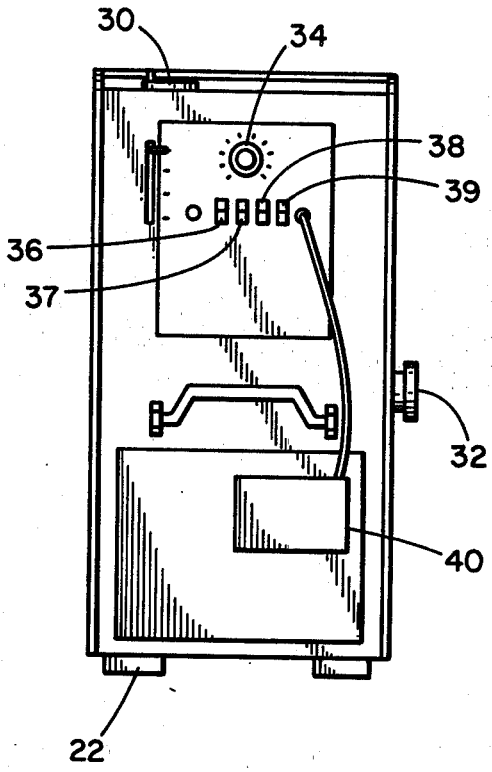
FIG. 2 is a rear elevation of the invention.

Referring now to FIGS. 1 and 2, the device according to the invention is illustrated. The ball throwing machine includes a housing 20. The top of the housing forms a ball bin 24 adapted to receive a supply of balls as, for example, tennis balls. Balls are ejected from the device through an opening 26 covered by a pivotable ball safety door 28 except when a ball is being projected from the machine. This is a safety feature tending to reduce the possibility of injury to the machine user. Positioned along a top portion of the housing is a control wheel 30 for adjusting the vertical trajectory of balls thrown from the machine. Similarly, on the side of the housing is a control knob 32 for adjusting the force with which the balls are ejected from the machine.

With reference to FIG. 2, the positioning of the electrical controls of the device is illustrated. An operating light 34 indicates when the unit is switched on while the rocker switches 36 through 39 perform various functions, such as, turning the motor on and off. If desired, a conventional remote control radio unit 40 can be provided whereby the invention can be switched on and off from a remote position as, for example, on the far side of a tennis court.

Figure 3:
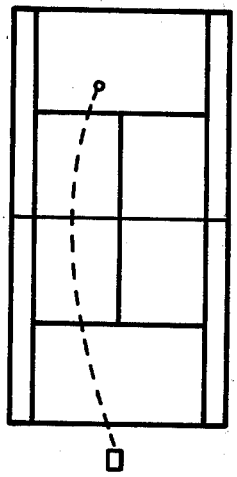
FIGS. 3, 4, and 5 illustrate the trajectory of balls projected from the invention dependent upon the mode of operation selected.
Figure 4:
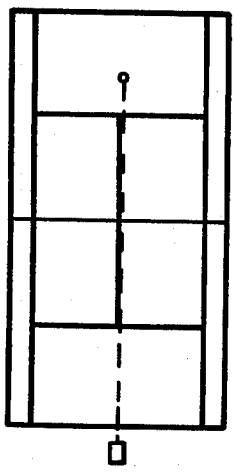
Figure 5:
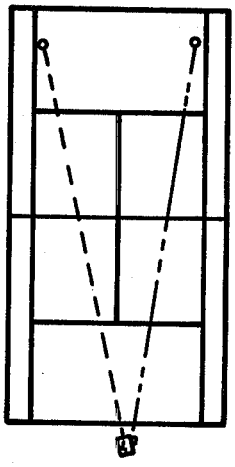

With reference to FIGS. 3 through 5, the effect of the trajectory force controls on the ball path can be seen. In FIG. 3 there is illustrated the use of the ball machine to throw lobs across a net. In FIG. 4 the device is being used to project a forehand or backhand volley with the force of the shot being adjustable by means of control knob 32. In FIG. 5 use is made of the oscillating feature of the invention whereby balls are alternately projected to opposite sides of the court.

Ball Loading

Referring now to FIGS. 6 through 9 the details of the invention are illustrated. With specific reference to FIG. 6, the ball bin 24 is illustrated along with the means for assuring a substantially jam free loading of balls into a ball delivery tube 42. When balls are placed into the bin 24 there is a tendency for them to bunch and stack one upon the other and otherwise become difficult to consistently feed to the projecting mechanism. This problem is aggravated in part by the outer texture of the balls which have a fur-like surface.

The ball bin is generally rectangular in shape and of a size sufficient to hold a reasonably large number of balls on the order of ten to twelve dozen. The bin bottom 44 is sloped towards the rear corner of the bin where the tube 42 is located. Provided in the bin is a ball fence 46 and ball agitator 48. The ball fence is connected by rod 50 to a pivot arm 52 located beneath the ball bin. Pivot arm 52 is secured to an internal support and pivots about hole 54. A portion of the ball tube 42 is connected to the other side of pivot arm 52 via rod 56. As will be readily appreciated by those skilled in the art, when the pivot arm rotates about its pivot point the tube 42 and ball fence 46 will alternately move up and down. This reciprocal action of the ball fence and tube in conjunction with movement of the ball agitator 48 is effective for substantially eliminating jam ups during loading of the balls.

Figure 6:
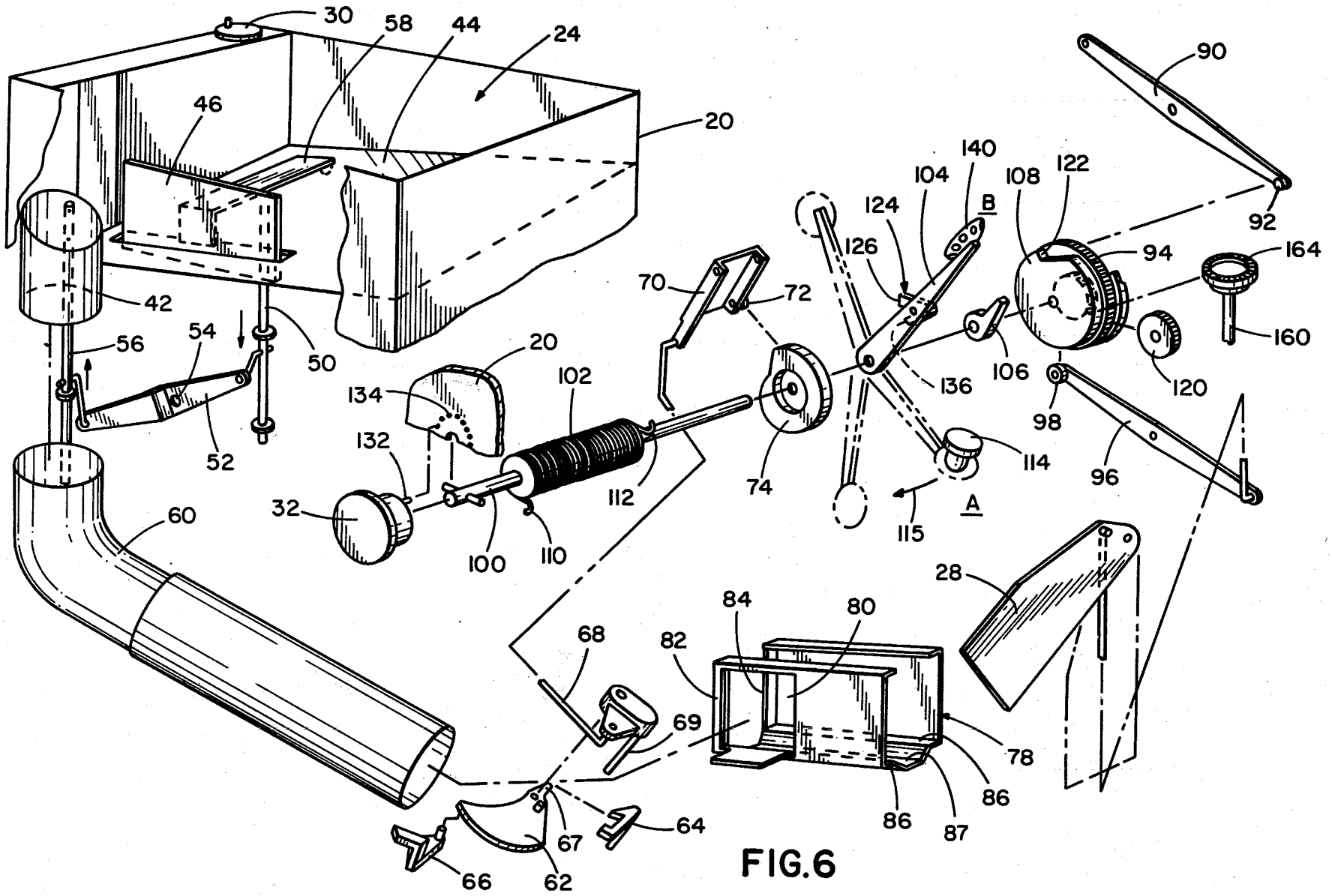
FIG. 6 is an exploded view of the ball feed system and projecting system according to the present invention illustrating the important details thereof.
Figure 7:
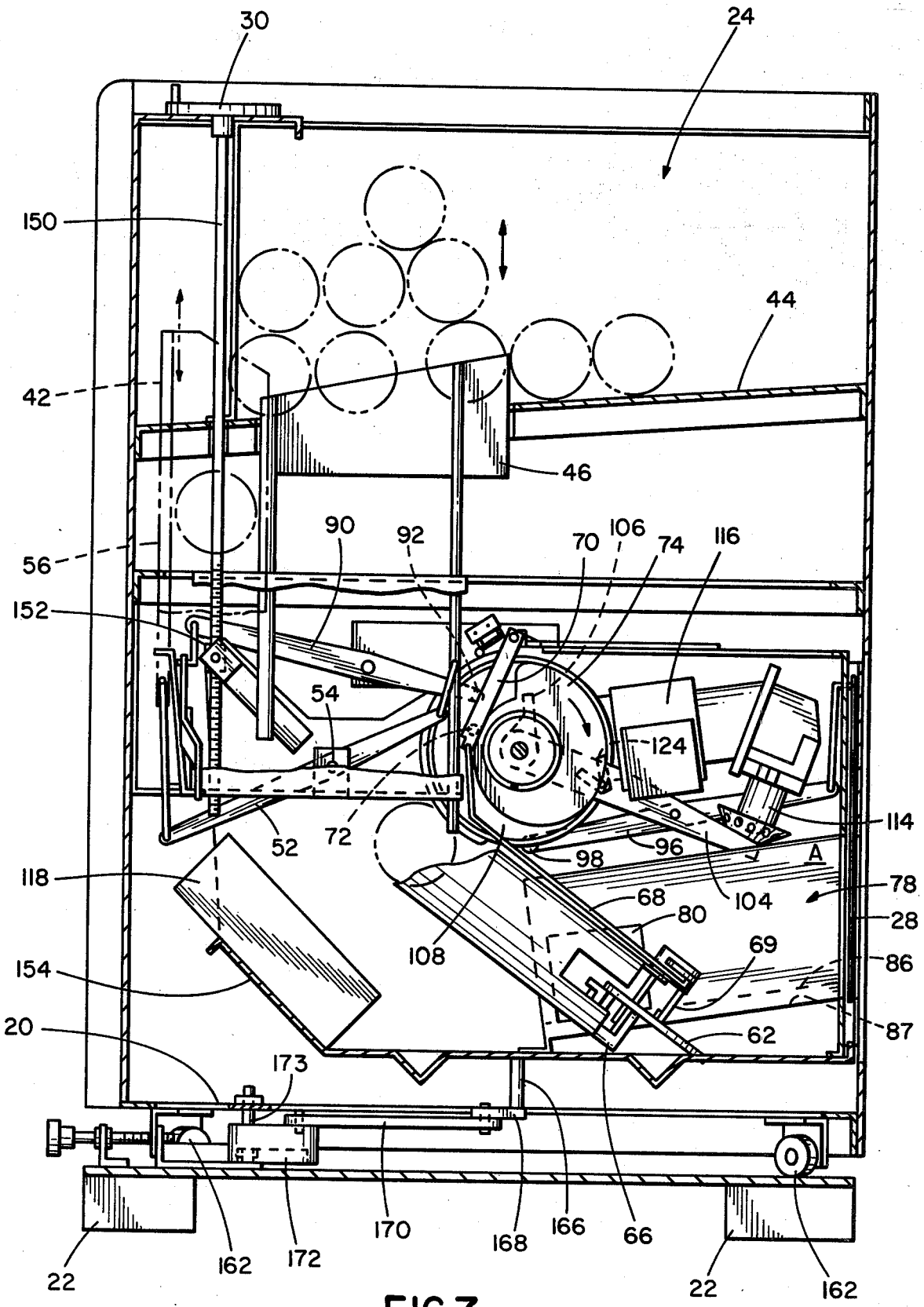
FIG. 7 is a side sectional view of the machine according to the invention illustrating the throwing arm in its released position.

As indicated in FIG 6, the ball agitator has one end attached to the ball fence 46 so that it moves up and down therewith while the end 58 is pivotally connected to the bottom of the ball bin. The spacing of the ball fence from the side of the ball is such that balls are forced to follow a path indicated in dashed lines in FIG. 6. That is, they must either pass around the side of the ball fence and then roll into the tube 42 when it is in its lowered position or the balls must pass over the ball fence into the loading area when the fence is down and the tube is raised. In the latter case the ball will not enter the tube until the tube is again in its lowered position. The action of the agitator and ball fence is effective for unbunching the balls particularly when they are stacked one upon the other and for breaking up any ball jam in the vicinity of the tube 42 should they occur.

Gate Mechanism

The lower portion 60 of the ball tube is fixed and slidably receives the movable portion. Once a ball has entered the tube it passes downwardly therefrom until it reaches a ball gate mechanism including a gate 62, a lower stop 64, and upper stop 66. The gate mechanism is driven by a linkage including rod 68, arm 70, and roller 72 which acts as a cam follower riding along the surface of a gate cam 74. As will be described, the gate cam 74 is mounted on the shaft 100 and secured to the throwing arm 104.

The ball gate mechanism is effective for permitting only one ball to pass into the ball track 78 during each cycle of machine operation. In effect, it is an indexing mechanism which simultaneously permits the forwardmost ball to roll into the ball track while blocking the passage of all the remaining balls lined up in the ball tube. Operation of the gate mechanism is as follows.

As the cam follower 72 traces the movement of the cam 74 during cocking of the throwing arm 104 the rod 68 is reciprocated in the correct sequence for dispensing a ball from the ball tube into the ball track 78. The ball gate 62 is initially in the position indicated in FIG. 6 whereby a ball passes downwardly in the tube 60 until it reaches the stop member 64. As the rod 68 causes rotation of the post 69, the gate 62 rotates into the ball tube while the lower stop 64 is simultaneously withdrawn permitting the forwardmost ball to roll downwardly into the ball track while the remaining balls in the tube are held back by the upper stop 66 which is pivoted with the gate into the tube. The gate includes a finger member 67 which engages the lower stop 64 as the gate begins its indexing movement to cause the withdrawal thereof. Similarly, the upper stop is carried by the gate. The return movement after a ball has entered the ball track causes withdrawal of the gate 62, the upper stop 66, and the reinsertion of the lower stop 64 into the ball path.

Ball Track

The lead ball, after passing the gate mechanism, passes through an opening 80 and onto the ball track 78. The ball track includes a pair of raised portions 86 on either side of a depressed portion 87. The spacing of the raised portions is such that a tennis ball is supported thereon without touching the recessed portion 87. Thus, clearance is provided for the throwing arm when it enters the ball track to strike the ball without any danger of it catching on the ball track. The ball track is titled rearwardly (see FIG. 7) so that as the ball enters the track it rolls rearwardly to a position of engagement with the back stops 82 and 84 where it rests until struck by the throwing arm.

The operation of the gate mechanism, the ball fence and the ball tube are in sequence with the operation of the throwing mechanism by virtue of the use of a number of camming surfaces for operating these elements in their proper sequence. Thus, for example, the ball fence 46 and ball tube 42 are interconnected to a lever 90 which has a cam follower 92 on one end thereof which bears against a surface provided on cam gear 94. As indicated previously, the gate mechanism is operated by the gate cam 74 in conjunction with the follower 72 provided on the element 70. Similarly, the ball door 28 is connected by a linkage which includes a lever 96 having a cam follower 98 which bears against a further surface on the cam gear 94 thereby to insure that the door is open when a ball is ready to be ejected from the machine but otherwise closed for safety.

Throwing Mechanism

With reference to FIG. 6, the ball throwing mechanism according to the invention will now be described. A shaft 100 is rotatably secured through the housing. Mounted concentrically on said shaft is a torsion spring 102, cam gear 74, throwing arm 104, release arm 106, ratchet gear 108 and cam gear 94. End 112 of the spring is connected to the throwing arm 104. The spring 102 is pretensioned so that when the throwing arm is in the position illustrated at A the throwing arm is under substantial tension and is restrained against a bumper 114. The throwing arm is cocked thereby further increasing the tension on the spring by moving it in the direction indicated by the arrow 115 to position B.

Figure 8:
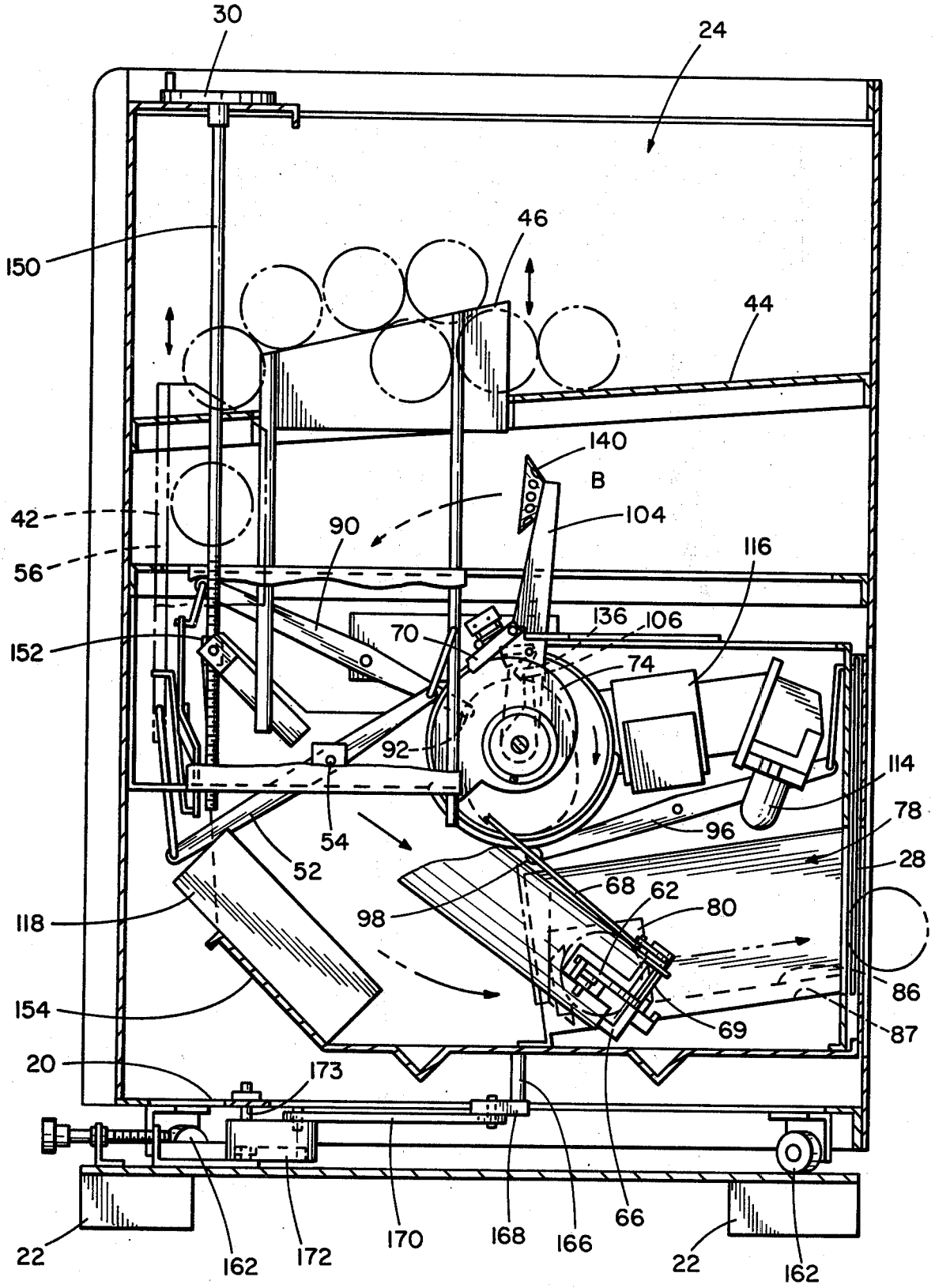
FIG. 8 is a view similar to FIG. 7 illustrating the throwing arm in its cocked position just prior to release.
Figure 9:
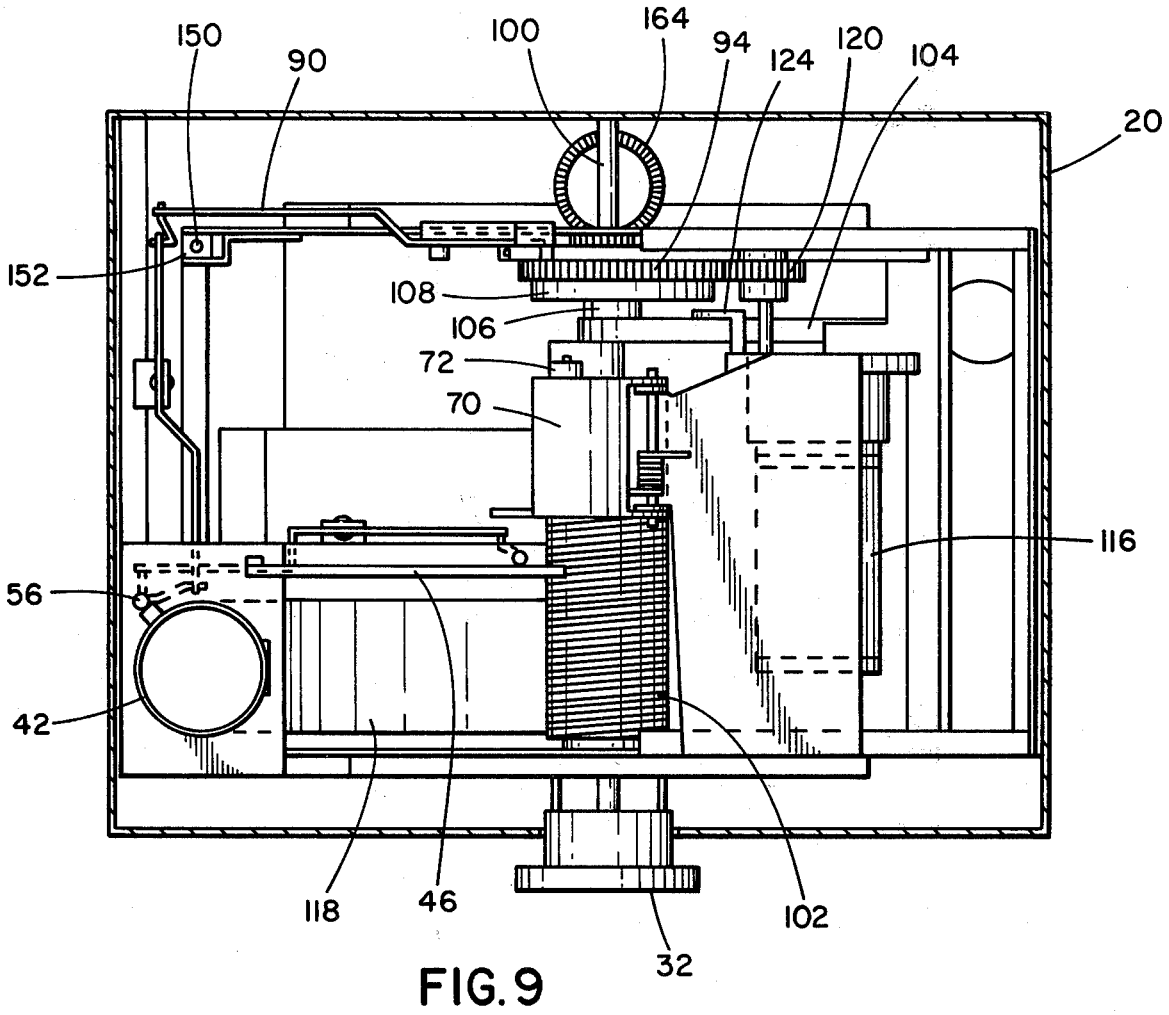
FIG. 9 is a plan view of the invention with the ball storage bin removed to reveal the throwing mechanism.

The gate cam 74 is attached to the throwing arm so that the movement of the arm controls the operation of the gate 62. In this manner ball jams on the ball track are avoided since a ball cannot be released from the ball tube to enter the ball track except when the arm is raised to the cocked position. The throwing arm 104 is driven from position A to position B by a motor 116 which may be operated by batteries 118 (FIG. 8). The motor 116 transmits its power via drive gear 120 which engages the cam gear 94. The ratchet 108 is connected to the cam gear or, preferably, may be a part of the cam gear. The motor rotates the cam gear and ratchet in the direction indicated.

The ratchet is provided with a single ratchet tooth 122 for engaging an arm latch pawl 124 secured to throwing arm 104 at a point about midway between the extremes thereof. The latch 124 is a V-shaped member pivotally pinned to the arm. The latch is spring loaded to bias it to a position in which the upper arm 126 of the latch bears against the surface of the ratchet 108. Thus, as the ratchet 108 rotates the arm latch leg 126 rides along the outer surface of the ratchet until it is captured by the tooth 122. When that occurs the throwing arm is carried by the ratchet from position A around to position B against the bias of torsion spring 102. In this manner the throwing arm is cocked preparatory to striking a ball which is simutaneously being loaded onto the ball track by the gate mechanism.

As indicated previously, the principal components of the throwing mechanism are positioned on shaft 100. However, none of the elements except released arm 106 are secured to the shaft for rotation therewith. Thus, the spring, the throwing arm and the gears are movable independently of the shaft 100 while release arm 106 is fixed to the shaft. The purpose of securing the release arm to the shaft is to permit accurate positioning of it at a desired point with respect to the arm latch 124. In this manner the point at which the throwing arm is released can be selected thereby determining the force with which the throwing arm strikes the ball.

Attached to one end of the shaft 100 is knob 32 which includes a locking pin 132 receivable in one of a plurality of holes 134 provided on the machine housing 20. The position of the knob 32 selects the position of the release arm 106. The release arm engages the lower leg 136 of the arm latch 124 causing the latch to pivot upwardly out of the ratchet tooth 122 (FIGS. 6 and 8). This frees the throwing arm from the driven ratchet permitting the torsion spring to rapidly move the arm from point B back to point A passing through the ball track thereby to eject the ball. As indicated, the adjustment of the knob 32 controls the point of release of the arm from the ratchet tooth thus controlling the spring tension and the distance the arm travels before striking the ball. This produces a highly accurate and reproducible striking force for any given position of the arm 106 whereby a desired ball path can be repeatedly obtained. This represents a substantial improvement over prior devices particularly those which employed air pressure and were generally unreliable with respect to repetitively throwing a ball along the same general path. After the throwing arm is released and strikes the ball its residual force is absorbed by the bumper 114 which holds it in its uncocked position until the ratchet 108 again rotates to a point where the upper leg 126 of the latch engages it to begin the cocking sequence. The further the throwing arm is cocked before the latch strikes the release arm 106 the harder the arm will subsequently strike a tennis ball in the ball track by virtue of the increasing tension exerted by spring 102. The end of the throwing arm is provided with a ball cup 140 which is preferably provided with a plurality of apertures therethrough to reduce wind resistance and the trapping of air between the cup and the ball during striking of the latter.

Figure 11:
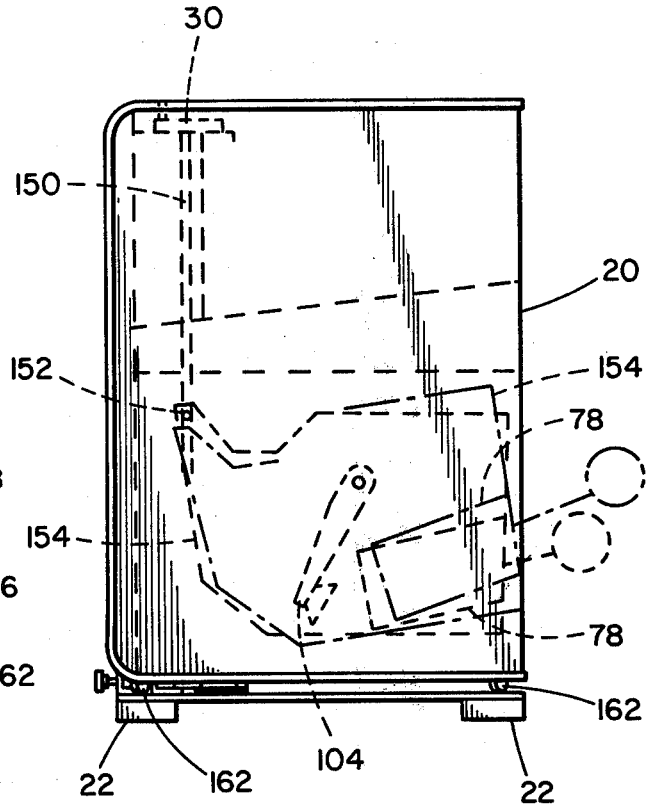
FIG. 11 is a side elevation illustrating vertical movement of the ball throwing unit to select a desired trajectory.

Turning now to the remaining features of the invention, there are two positioning adjustments which can be effected by the user to obtain a desired trajectory for a given purpose. The vertical angle at which the ball is ejected is adjusted by control 30 (FIG. 11) which is attached to a threaded shaft 150. Shaft 150 passes downwardly into the machine to a point of engagement with a nut-like member 152 secured to the throwing mechanism housing 154 rather than the ball machine housing 20. The throwing mechanism housing 154 is separate and can be vertically rocked with respect to the housing 20 to change the angle of incline of the ball track. Thus, by rotating the wheel 30, the shaft 150 can be threaded into the nut member 152 to adjust the angle of incline of the ball track 78 as desired.

Figure 13:
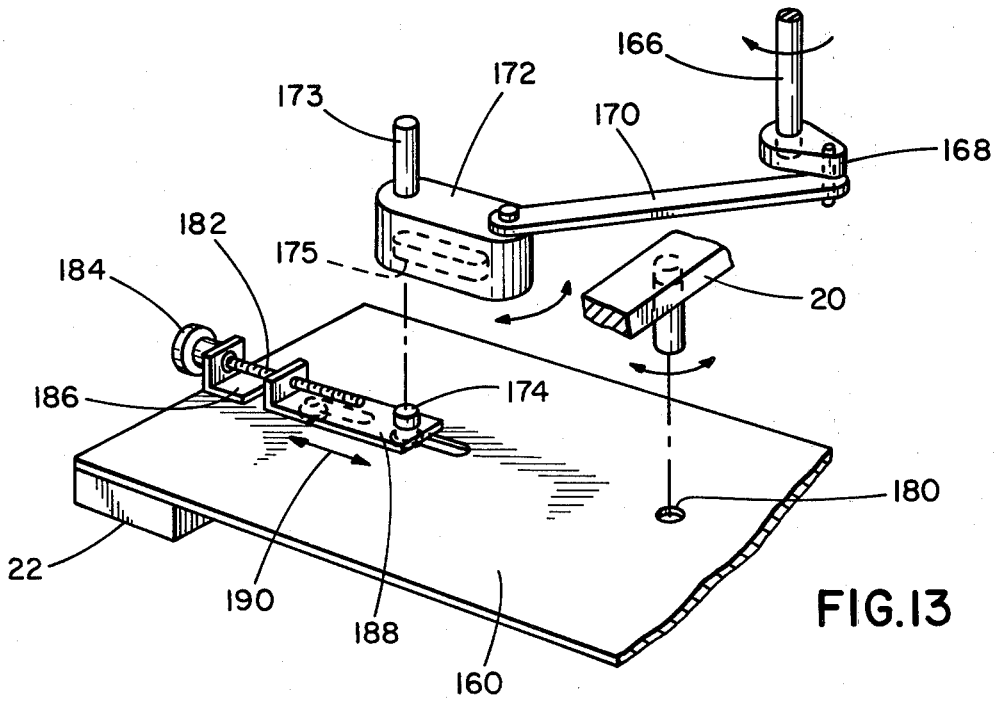
FIG. 13 is a fragmentary perspective view illustrating the oscillating mechanism according to the invention.
Figure 10:
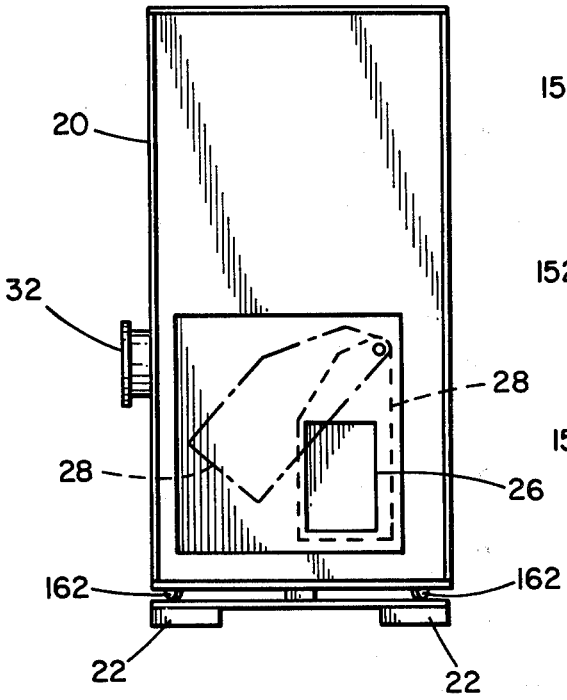
FIG. 10 is a front elevation illustrating operation of the ball safety door.
Figure 12:
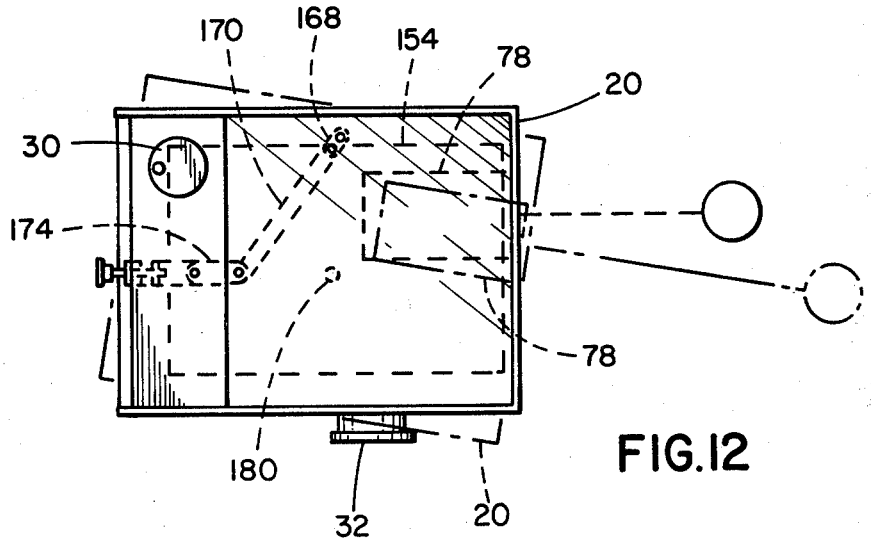
FIG. 12 is a schematic plan view illustrating the side to side oscillatory movement of the device.

Referring now to FIGS. 8, 12 and 13, the oscillating mechanism according to the invention is illustrated. The ball housing 20 is positioned on a base 160 to which the base pads 22 are attached. The housing 20 is provided with a set of rollers 162 for permitting the housing to move relative to the base in the manner illustrated in FIG. 12. That is, the housing can move between left and right positions by oscillating about a central pivot point connected to the stationary base. This oscillating motion is obtained by use of a gear linkage connected to the motor. Specifically, the oscillating drive includes a gear 164 (FIG. 6) which is driven off of the cam gear 94 or, alternatively, off of the motor gear 120. A shaft 166 (FIG. 13) is rotated by the gear 164 and, in turn, drives an eccentric member 168. Pinned to the eccentric is one end of rod 170, with the other end being connected to crank 172. As indicated by the arrow in FIG. 13, as shaft 166 rotates, the crank 172 reciprocates about pin 173.

As the crank 172 reciprocates it causes a reciprocation of the housing 20 by virtue of pin 174 which is secured to the base (FIG. 8). As indicated in FIG. 13, the housing 20 pivots in an aperture 180 provided in the base 160.

Crank 172 has a hollow elongaged interior 175 indicated by the dashed lines whereby the degree of oscillation of the unit can be controlled. The location of the pin 174 can be adjusted by means of a threaded shaft 182 which is connected to a knob 184. The shaft is threaded through a fixed plate 186 and a movable plate 188 on which pin 174 is provided. As the pin 174 moves between the positions indicated by arrow 190, the amplitude of oscillation is controlled. As the pin 174 moves towards the plate 186, oscillation is gradually reduced to zero since the effective lever arm between the rod 173 and pin 174 is reduced to zero. When pin 174 is moved away from the plate 186, the effective lever arm is increased producing progressively greater side to side movement of the housing, as illustrated in FIG. 12.

Thus, the housing 20 pivots about hole 180 on the rollers 162 in accordance with the setting of the control 184 which selects the effective lever between rod 173 and pin 174. By correct gearing of the shaft 166 the device can be timed to eject a ball at the extremes of its reciprocal movement to produce the effect illustrated in FIG. 5.

Figure 14:
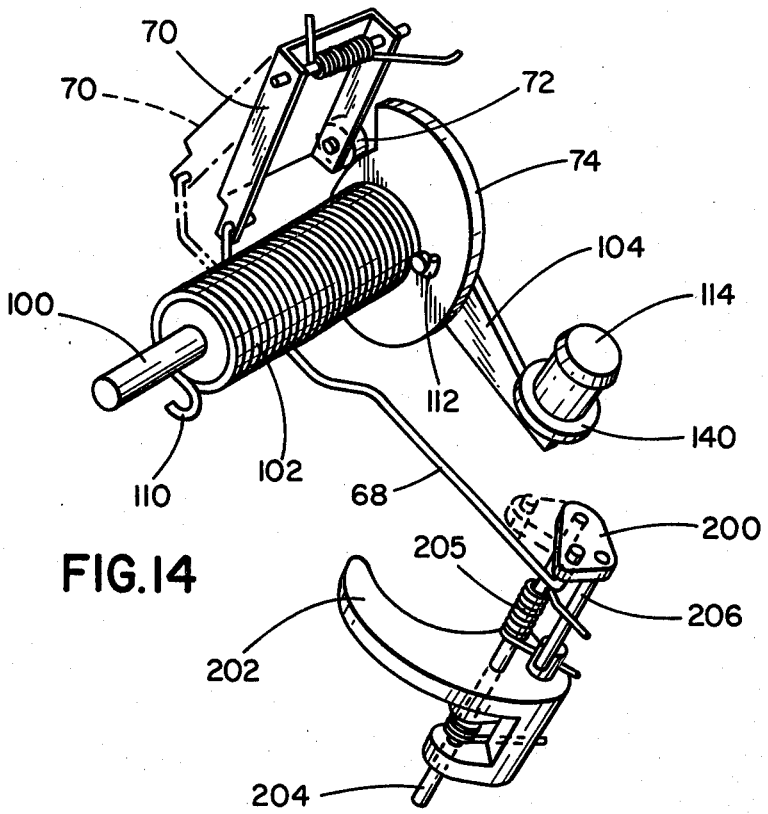
FIGS. 14 and 15 illustrated an alternate and preferred construction of the ball gate illustrated in FIG. 6.
Figure 15:
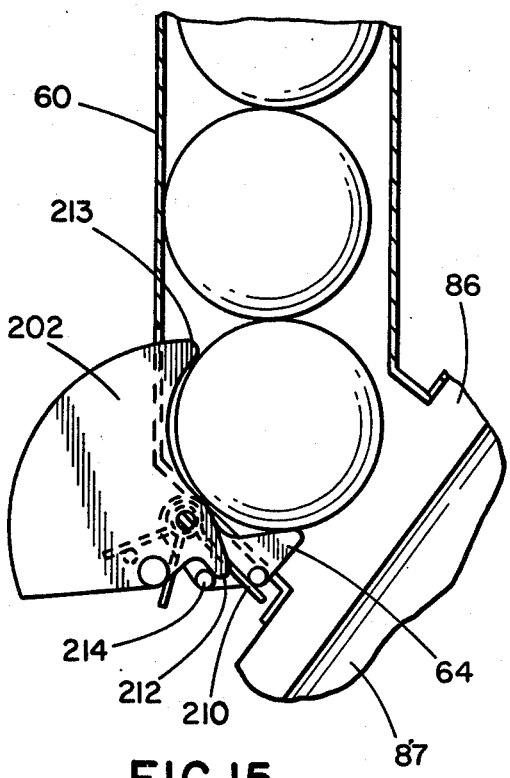

Referring now to FIGS. 14–15, a second embodiment of the ball gate is illustrated. In this embodiment, as contrasted with the ball gate of FIG. 6, a two piece construction is employed of a somewhat simpler and more reliable design. As with the FIG. 6 embodiment the ball gate is controlled by the cam 74 mounted to the shaft 100 and the associated linkage including rod 68. Rod 68 causes rotation of arm 200 to which is connected the ball gate 202 via shaft 204 and post 206. A spring 208 is provided as protection against malfunction in the event that a ball jam occurs. This spring permits over travel by allowing arm 200 to rotate without rotation of gate 202. As indicated in FIG. 15, the gate 202 operates in conjunction with a single ball stop 64 which pivots about the same shaft as the gate.

Figure 16:
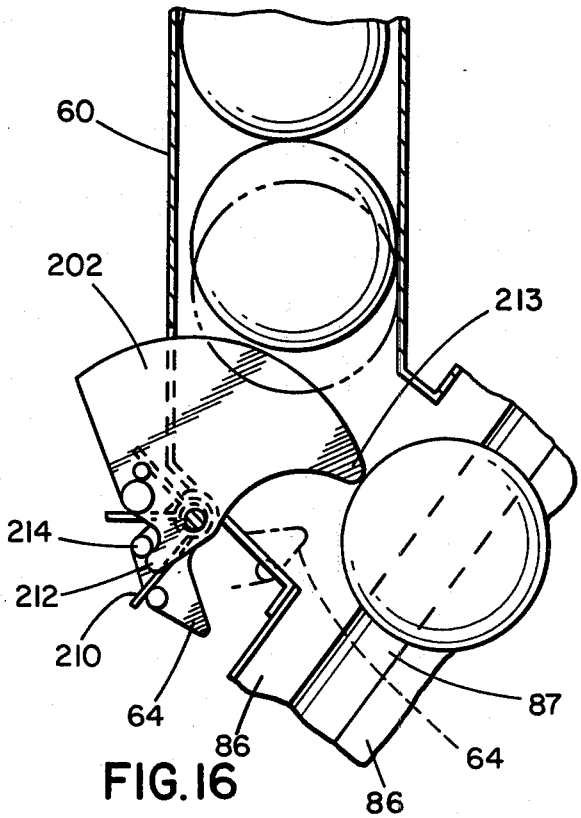
FIG. 16 shows the pivoted gate stopping a flow of balls.

Initially, the stop 64 extends into the ball tube, as illustrated, by virtue of a spring 210. As the rod 68 begins movement of the ball gate the upper tip 213 of the gate contacts the ball (FIG. 15) while the ball stop 64 is still holding the ball in position. As the gate continues to rotate a finger-like member 212 provided on the lower end of the gate engages a boss 214 on the stop 64 initiating withdrawal of the stop from the ball tube. As the gate continues its movement into the tube the stop becomes fully withdrawn permitting the lead ball to leave the ball tube and enter the ball track by force of gravity. Balls above the gate are held back by the upper curved surface of the gate as indicated in FIG. 16. The gate tip 213 thrusts the lead ball forward tending to clear any jam which might occur at the point where the tube engages the track (FIG. 15). After a ball has been dispensed into the ball track the gate and stop return to their initial positions whereby the next ball in the tube is held ready for release after a ball has been ejected by the throwing mechanism.

While we have shown and described embodiments of this invention in some detail, it will be understood that this description and illustrations are offered merely by way of example, and that the invention is to be limited in scope only by the appended claims.

We claim:

1. A ball throwing machine comprising:
(a) a ball bin for holding a supply of balls,
(b) a ball firing track,
(c) a ball tube for conveying the balls from the bin to the track,
(d) fence and agitator means for feeding balls from the bin to the tube with minimal jamming,
(e) means for striking a ball positioned on said ball track,
(f) gate means for permitting one ball at a time onto said ball track,
(g) said ball tube includes upper and lower sections and said fence and agitator means includes:
(i) a ball fence and agitator connected thereto provided in said bin for unbunching balls and feeding them toward the upper section of said ball tube, and
(ii) means for reciprocating the ball fence and the upper tube section such that when one is in a raised position the other is lowered whereby the fence and tube cooperate to load balls into the tube.

2. The machine according to claim 1 further including means for oscillating said machine from side to side to vary the path of balls thrown therefrom.

3. The machine according to claim 2 wherein said oscillating means includes means for operating said oscillating means synchronously with said striking means whereby a ball is thrown from the machine at the extreme points of the oscillating motion of said machine.

4. The machine according to claim 1 further including means for raising and lowering the ball track to vary the angle with respect to the horizontal at which a ball leaves the machine.

5. The machine according to claim 1 further including a safety door positioned in front of said track during loading of a ball onto said track and pivotable away from the track when a ball is ready to be struck, said door reducing the chance of injury from a user inserting a limb into the machine.

6. The machine according to claim 1 wherein said ball bin is sloped toward said ball tube.

7. The machine according to claim 1 wherein said ball firing track includes a pair of raised surfaces spaced to support a ball therein over a depressed surface, the latter surface providing clearance to prevent interference with the striking means.

8. The machine according to claim 1 wherein said means for striking includes:
(a) an arm for striking balls on said track,
(b) means for biasing said arm to a first position,
(c) means for moving said arm to a release position against the bias of said biasing means,
(d) means for abruptly releasing said arm when it reaches said release position whereby said arm rapidly moves from said release position to said first position striking a ball.

9. The machine according to claim 8 wherein said arm is provided with a ball cup for striking a ball, said cup having apertures therethrough to prevent trapping air between said cup and a ball.

10. The machine according to claim 8 wherein said biasing means includes a preloaded torsion spring, one end of said spring secured to the machine housing, the other end thereof being secured to said arm, the preload on said spring biasing said arm to said first position.

11. The machine according to claim 8 wherein said moving means includes:
(a) a motor,
(b) a gear driven by said motor,
(c) latch means on said arm for releasably engaging said gear, whereby said motor moves said arm to said release position when said latch means engages said gear.

12. The machine according to claim 11 wherein said releasing means includes a release pawl disengaging said latch means from said gear when said arm reaches said release position.

13. The machine according to claim 12 wherein said releasing means further includes means for selecting the release position, said selecting means including:
(a) a shaft to which said pawl is secured for rotation therewith, rotation of said shaft changing the point at which the latch means is disengaged from said gear,
(b) means for securing said shaft at a desired position.

14. The machine according to claim 11 wherein said latch means includes:
(a) a latch member pivotable on said arm between first and second positions,
(b) spring means for biasing said member to a first position for engaging said gear, said releasing means effective for momentarily pivoting said latch member to said second position to release said member from said gear.

15. The machine according to claim 8 wherein said releasing means further includes means for selecting the release position of said arm thereby to vary the force with which the arm strikes a ball.

16. The machine according to claim 8 wherein said releasing means includes a release pawl disengaging said arm from said moving means when said arm reaches said release position.

17. The machine according to claim 16 wherein said releasing means further includes means for selecting the release position, said selecting means including:
(a) a shaft to which said pawl is secured, rotation of said shaft changing the point at which the arm is disengaged from said moving means,
(b) means for securing said shaft at a desired position.

18. The machine according to claim 1 wherein said gate means includes:

(a) a crescent shaped gate pivotable into and out of said ball tube, said gate when in said tube permitting only the lead ball to move in said tube, (b) a stop member for restraining the lead ball in said tube positioned below and coupled to said gate such that as said gate moves into said tube said stop is withdrawn from said tube to permit the lead ball to pass out of said tube into the ball track.

19. A ball throwing machine comprising:

(a) a ball bin for holding a supply of balls, (b) a ball firing track, (c) a ball tube for conveying the balls from the bin to the track, (d) fence means for feeding balls to the tube, (e) means for simultaneously reciprocating the tube and fence means relative to each other.

(f) means for oscillating said machine from side to side, and (g) means for striking a ball positioned on said ball track and driving said oscillating means in synchronism therewith.

* * * * *